US005283619A

United States Patent [19]

Nomura et al.

[11] Patent Number: 5,283,619

[45] Date of Patent: Feb. 1, 1994

[54] DEVELOPING APPARATUS AND PROCESS CARTRIDGE HAVING SAME

[75] Inventors: Yoshiya Nomura, Tokyo; Hironobu Isobe, Yokohama; Kazuo Shishido, Kawasaki; Kouji Miura, Sagamihara, all of Japan

[73] Assignee: Canon Kabushiki Kaisha, Tokyo, Japan

[21] Appl. No.: 988,905

[22] Filed: Dec. 10, 1992

[30] Foreign Application Priority Data

Dec. 20, 1991 [JP] Japan ..... 3-355902

[51] Int. Cl.[5] ..... G03G 15/06

[52] U.S. Cl. ..... 355/261; 118/647; 118/649; 118/657; 355/245; 355/263; 355/219; 384/215

[58] Field of Search ..... 355/261-263, 355/246, 245, 200, 210, 251, 211, 213, 219; 118/647-649, 661, 656, 657, 658; 361/225; 384/215, 220, 539

[56] References Cited

U.S. PATENT DOCUMENTS 4,205,622 6/1980 Miyake et al. ..... 118/661
4,344,700 8/1982 Kasama et al. .
4,591,258 5/1986 Nishino et al. .
4,839,690 6/1989 Onoda et al. ..... 355/211
4,975,744 12/1990 Ebata et al. ..... 355/211
5,020,471 6/1991 Yoshikai ..... 355/245 X
5,038,172 8/1991 Schreyer ..... 355/211
5,134,960 8/1992 Shirai ..... 118/653
5,196,889 3/1993 Ronnenberg et al. ..... 355/246 X

FOREIGN PATENT DOCUMENTS 153966 9/1983 Japan .

*Primary Examiner*—Matthew S. Smith
*Attorney, Agent, or Firm*—Fitzpatrick, Cella, Harper & Scinto

[57] ABSTRACT

A developing apparatus for developing an electrostatic latent image includes a fixed electrode for receiving a developing bias voltage; a rotatable and electrically conductive sleeve for carrying developer to a developing zone to supply developer to the electrostatic latent image; a flange fixed to an end of the sleeve, the flange including an electrode supporting portion; and an elastic electrode fixedly supported on the flange, the elastic electrode including a first portion engaged with the electrode supporting portion, a second portion press-contacted to the sleeve, and a third portion elastically and slidably press-contacted to the fixed electrode.

24 Claims, 11 Drawing Sheets

DEVELOPING APPARATUS AND PROCESS CARTRIDGE HAVING SAME

FIELD OF THE INVENTION AND RELATED ART

The present invention relates to a developing apparatus usable with an image forming apparatus such as an electrophotographic copying machine, an electrophotographic type laser beam printer or the like, and also to a process cartridge detachably mountable to an image forming apparatus and having at least a developing apparatus and an image bearing member.

Referring first to FIGS. 6 and 7, there is shown an example of a conventional developing apparatus. As shown in these Figures, in the developing apparatus 1, a developing sleeve 5 made of non-magnetic material is rotatably supported in a developing chamber 3 of a developer container 2. In the developing sleeve 5, a magnet roller 6 having a plurality of magnetic poles is contained. To the developing sleeve 5, an elastic blade 7 is contacted. The blade 7 is mounted on the developer container 2. To the opposite longitudinal ends of the developing sleeve 5, spacer rollers 10L and 10R in the form of caps are fitted. By unshown urging means, the rollers 10L and 10R are press-contacted to an electrophotographic photosensitive member 9, by which the clearance or gap is maintained between the sleeve 5 and the photosensitive member 9.

Magnetic toner particles (developer) are supplied to the developing chamber 3 from an unshown toner container through an inlet opening 11 of the developing chamber 3 by an unshown conveying means or by gravity. Then, the toner in the developer chamber 3 is attracted onto the developing sleeve 5 by the magnetic force of the magnet roller 6, and is conveyed in the direction of an arrow in FIG. 6 on the developing sleeve 5 which is rotating. The toner is pressed to the developing sleeve 5 by the blade 7 so as to receive triboelectric charge. With the rotation of the developing roller 5, the toner is carried on the sleeve 5 out of the developing chamber 3. The blade 7 is effective to triboelectrically charge the toner or to increase the charge amount of the toner, and is also effective to regulate a thickness of a toner layer on the developing sleeve 5.

The developing sleeve 5 is made of aluminum alloy or other electrically conductive material and is supplied with a developing bias voltage from a developing bias source 14 in the main assembly of the image forming apparatus.

Therefore, the toner conveyed on the developing sleeve 5 from the developing chamber 3 is transferred onto the electrostatic latent image on the photosensitive member 9 by the developing bias voltage in the developing zone. The toner develops the electrostatic latent image. The residual toner not having been used for the development returns into the developing chamber 3 by the rotation of the developing sleeve 5.

To an inside of the developing sleeve 5 at one longitudinal end thereof, a flange 15 is fitted and fixed thereto, and the flange 15 is supported by a bearing 16R. On the other hand, the other longitudinal end of the developing sleeve 5 is provided with the spacer roller 10L fitted thereto at the outer periphery thereof. The outer peripheral surface of the spacer roller 10L is supported by a bearing 16L. To the flange 15, a gear 20 is fixed, and the gear 20 is meshed with a gear 9a fixed to the photosensitive member 9, and therefore, the sleeve 5 rotates in synchronism with the photosensitive member 9.

As shown in FIGS. 8 and 9, a bias electrode 12' effective to apply the developing bias voltage to the developing sleeve 5, is fixed to the developing sleeve 5 by press-contacting pawls $12a_1$, $12b_1$, $12c_1$ and $12d_1$ formed in the outer periphery, into the internal surface of the developing sleeve 5, so that the bias electrode 12' is electrically connected to the developing sleeve 5.

The bias electrode 12' provided with arms $12e_1$ and $12f_1$ formed therein. The arms $12e_1$ and $12f_1$ are resiliently and slidably contacted to a fixed electrode plate 17 in the form of a ring mounted to the developer container 2 of the process cartridge. The electrode plate 17, when the process cartridge is mounted in the main assembly of the image forming apparatus and fixed in place for an image forming operation, is electrically connected with an electric contact of the main assembly of the image forming member, the contact 13 is supplied with the developing bias voltage from the voltage source 14.

End shaft portions 6L and 6R of the magnet roller 6 are fixedly mounted on the developer container 2.

One of drawbacks of the conventional apparatus is as follows. Since the bias electrode 12' is resiliently press-contacted to the electrode plate 17 with elastic deformation, the bias electrode 12' is gradually moved toward the rear of the developing sleeve 5 (to the left as viewed in FIG. 8) by vibration of the image forming apparatus or by repeated use. It will be understood this is because the bias electrode 12' is fitted into the developing sleeve 5, and the pawls, $12a_1$, $12b_1$, $12c_1$ and $12d_1$ of the bias electrode 12' have the configurations as shown in FIGS. 8 and 9. The bias electrode 12' is not easily movable in a direction away from the developing sleeve 5 (to the right as viewed in FIG. 8), but the bias electrode 12' is readily movable into the sleeve 5 by a relatively weak force. When the electrode is shifted toward the rear of the developing sleeve 5 by the contact pressure between the arms $12e_1$ and $12f_1$ and the electrode plate 17, the contact pressure decreases with the result of instability in the electric connection between the electrode plate 17 and the bias electrode 12'. For this reason, the image density of the developed image tends to decrease, or the image tends to become uneven.

Another drawback is that since the spacer roller 10L is supported by the bearing 16L at a side where the bias electrode 12' is fixed, the positional accuracy of the developing sleeve 5 relative to the developer container 2 is deteriorated, corresponding to the play in the engagement between the internal surface of the spacer roller 10L and the external surface of the developing sleeve 5. For this reason, when the sleeve 5 is rotated, the gap between the sleeve 5 and the photosensitive member 9 periodically changes with the result that a periodical density unevenness is produced in the developed image.

Referring to FIG. 17, the description will be made as to another conventional apparatus. In the apparatus of FIG. 17, end portions of the shaft portions 6R and 6L at the right and left, respectively of the magnet roller 6, are supported on holders 19R and 19L at the right and the left, respectively fixed on the developer container 2. The developing sleeve 5 is so disposed as to cover the magnet roller 6 with a small clearance over the magnetized portion 63 which has a larger diameter than the shaft portions 6L and 6R of the magnet roller 6. The flanges 15L and 15R fixed to the opposite ends thereof, are supported and correctly positioned relative to the bearings 16L and 16R which are fixed to the developer container 2. At the opposite ends of the shaft portions 6L and 6R of the magnet roller 6, an amount of play S for assembling, is present relative to the holders 16L and 16R. The play amounts S are required in consideration of the tolerance of the part, since the magnet roller 6 is received between the left and right holders 19L and 19R.

However, within the play amounts or tolerances S, the magnet roller is movable in the thrust direction, and therefore, when the magnet roller 6 moves to the left or to the right through the tolerance S, the magnetic force is produced outside the region M of the developing sleeve 5 facing the image, that is, outside the region which requires the magnetic force. As a result, the toner is attracted to the surface of the developing sleeve 5 outside the image region M, and therefore, the toner consumption is wastefully increased, or improper image formation is carried out.

SUMMARY OF THE INVENTION

Accordingly, it is a principal object of the present invention to provide a developing apparatus or a process cartridge in which a developing bias voltage can be stably supplied to a developing sleeve.

It is another object of the present invention to provide a developing apparatus and a process cartridge in which a magnet can be stably maintained at a predetermined position.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
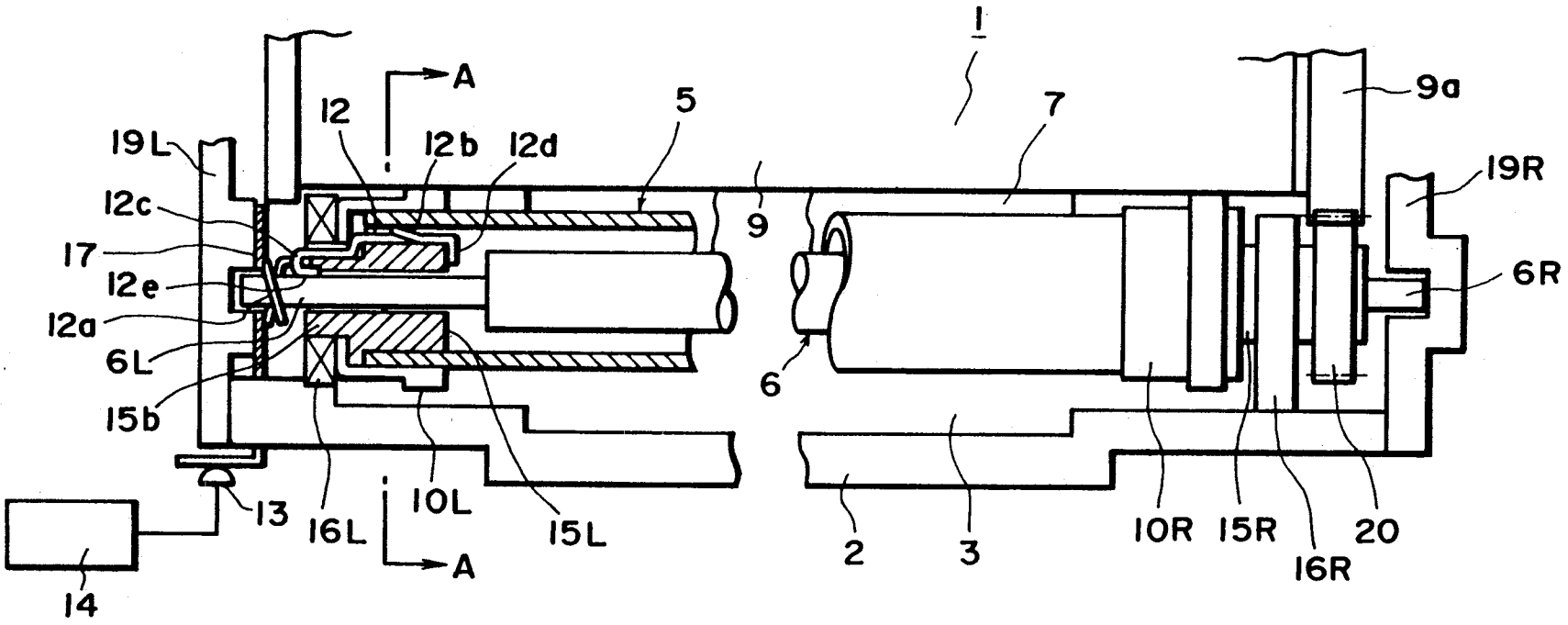
FIG. 1 is a sectional view of a developing apparatus according to an embodiment of the present invention.
Figure 2:
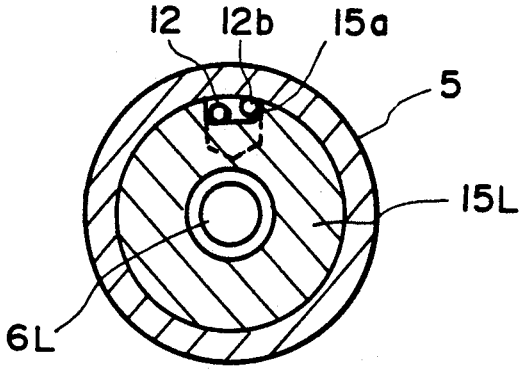
FIG. 2 is a sectional view taken along a line A—A of FIG. 1.

Referring to the accompanying drawings, the preferred embodiments of the present invention will be described. In the following descriptions, the same reference numerals as in FIGS. 6, 7, 8 and 17, are assigned to the elements having the corresponding functions, and the detailed descriptions thereof are omitted for simplicity.

A developing apparatus 1 of a process cartridge which is detachably mountable to the main assembly of the image forming apparatus, comprises, as shown in FIG. 1, a cylindrical developing sleeve 5 made of electrically conductive and non-magnetic material such as aluminum or stainless steel or the like, and left and right end flanges 15L and 15R fixed to the corresponding ends of the sleeve 5. The left flange 15L is fixedly mounted to the left end of the developing sleeve 5 by means of pressing, bonding, clamping or the like. The flange 15L is provided with a shaft portion 15*b* projected outwardly from the developing sleeve 5. The shaft portion 15*b* is rotatably supported by a bearing 16L fixed to the developer container 2. On the other hand, to the right longitudinal end of the developing sleeve 5, a flange 15R is similarly fixedly mounted by means of press-fitting, bonding or clamping or the like. The outer periphery of the flange 15R is rotatably supported by a bearing 16R fixedly mounted on the container 2. In addition, a sleeve gear 20 is fixedly mounted on the flange 15R by means of a key, set screw or the like (not shown). Therefore, the developing sleeve 5 is supplied with the driving force through the sleeve gear 20 from a drum gear 92 mounted on the photosensitive member 9, so that it is rotated with a predetermined rotational speed.

The flange 15L is made of electrically insulative synthetic resin material. In the shown example, the shaft portion 15*b* of the flange 15L is engaged with the bearing 16L, and therefore, it is preferable that the flange 15L is molded of polycarbonate resin or the like into which polyacetal resin material, polybutyrene terephthalate resin material, polyamide resin material, tetrafluoroethylene resin material or the like, to provide satisfactory lubricity.

Since the flange 15R does not support the electrode 12 which will be described in detail hereinafter, it may be made of metal. However, it is preferable from the standpoint of proper weight that it is molded of synthetic resin material which may be the same as the flange 15L.

The magnet roller 6 having a plurality of magnetic poles, is contained in the developing sleeve 5. The shaft portions 6L and 6R penetrate through the central holes of the sleeve flanges 15L and 15R, and are fixedly supported by the holder 19L and 19R fixed on the developer container 2.

Figure 3:
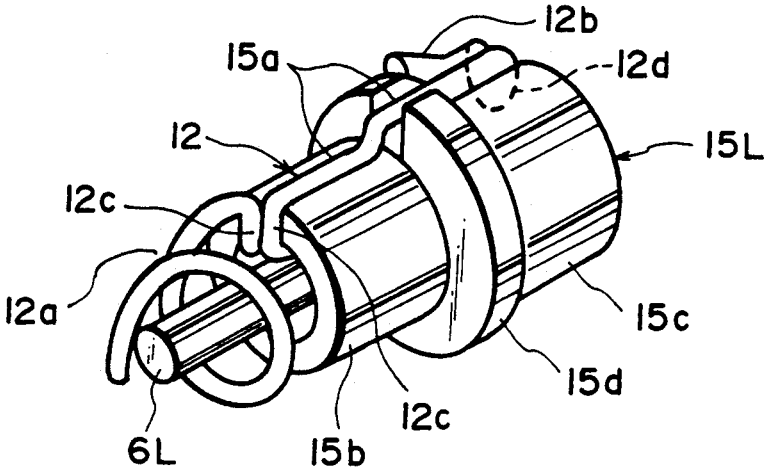
FIG. 3 is a perspective view of a flange and a bias electrode used in the FIG. 1 embodiment.

The left flange 15L is provided with a bias electrode 12 built therein, as shown in FIG. 3. The bias electrode 12 is made of elastic metal such as piano wire, stainless wire, phosphor bronze or the like. A spring portion 12*a* at an end thereof is formed into a coil spring to provide a spring property, so that it is slidably contacted with a predetermined force to an electrode ring 17, to establish an electric connection. A resilient portion 12*b* at the other end of the bias electrode 12 is projected out of the outer circumference of the sleeve flange 15L, and is press-fitted into the sleeve 5. It is elastically contacted to the inside surface of the developing sleeve 5 between the sleeve inside surface and the flange outside surface to establish an electric connection with the developing sleeve 5. Thus, by mounting the process cartridge having the developing device 1 at an image forming operation position in the main assembly of the image forming apparatus, the developing bias voltage is applied from the developing bias voltage source 14 to the electrode plate 17 through the contact 13, and the developing bias voltage is supplied to the developing sleeve 5 through the bias electrode 12.

On the other hand, the shaft portion 15*b*, engaging portion 15*c* engageable with the sleeve and a large diameter portion 15*d* of the flange 15L are provided with grooves 15*a*, and the bias electrode 12 is fitted in the groove 15*a*. Therefore, the bias electrode 12 does not impede rotation of the developing sleeve or impede engagement between the flange 15L and the inside surface of the developing sleeve 5. The bias electrode 12 is provided with bent portions 12*c* and 12*d* bent toward the center of the flange 15L at each of the longitudinal ends of the flange 15L. The bent portions 12*c* and 12*d* function to sandwich the flange 15L in the longitudinal direction. By doing so, the bias electrode 12 is prevented from falling from the flange 15L in the sleeve longitudinal direction with even further certainty.

The bent portion 12*c* of the bias electrode 12 is formed into an engaging portion 12*e* (FIG. 1) bent toward the inside of the sleeve flange 15L. In cooperation with the bias electrode portion in the groove 5*a* formed on the outer surface of the shaft portion 15*b*, the engaging portion 12*e* functions to sandwich the flange 15L in the radial direction of the sleeve. Therefore, the bias electrode 12 is prevented from being raised from the groove 15*a* of the flange 15L to interfere with the bearing 16L, Simultaneously, the engaging portion 12*e* of the bias electrode 12 envelopes the flange 15L in cooperation with the other bent portion 12*d*, and therefore, it is mounted to the flange 15L without play. The resilient portion 12*b* of the bias electrode 12, when it is inserted and fixed into the developing sleeve 5, opens toward the opening of the developing sleeve 5, so that the insertion of the flange 15L into the sleeve 5 is not prevented, and in addition, after the insertion, the release from the sleeve 5 is prevented. Therefore, the flange 15L may be fixed to the developing sleeve 5 with light force, that is, with light press-fitting, if press-fitting is used. This makes the operation easier.

In the bias electrode 12, the spring portion 12*a*, resilient portion 12*b*, the portion engageable with the groove 15*a* of the flange 15L, the bent portions 12*c* and 12*d* engageable with the flange 15L and the engaging portion 12*e*, are formed by one part, so that it will suffice if it is mounted to the sleeve flange 15L, thus facilitating the assembling operation.

Figure 4:
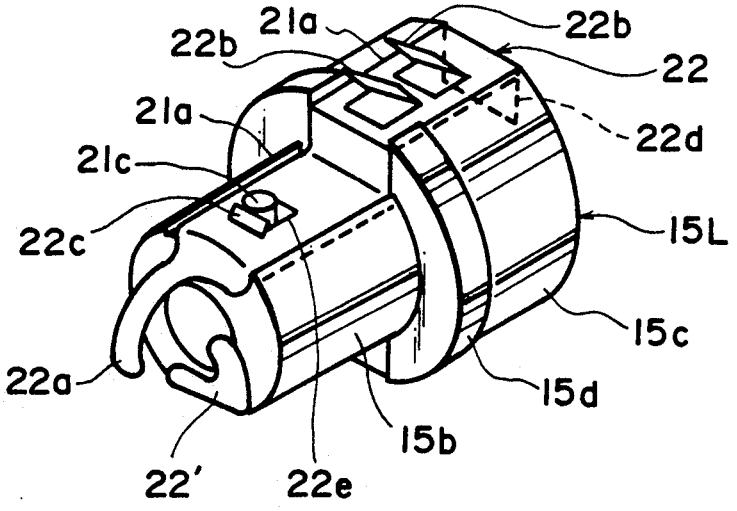
FIG. 4 is a perspective view of a flange and a bias electrode according to another embodiment of the present invention.

Referring to FIG. 4, a flange according to another embodiment will be described. A groove 21*a* is also formed in the shaft portion 15*b* of the flange 15L, engaging portion 15*c* to the sleeve and the large diameter portion 15*d*. The bias electrode 22 is made of stainless belt used for springs or phosphor bronze wire or the like, and an end thereof is provided with arcuated spring arm 22*a*, which is slidably contactable to the above-described fixed electrode plate 17 with a predetermined contact pressure so as to establish an electric connection. On the other hand, when the flange 15L is inserted into and fixed to the developing sleeve 5, a cut and bent portion (resilient portion) 22*b* is contacted to the inside surface of the developing sleeve 5 to establish the electric connection. Simultaneously, the cut and bent portion 22*b* is effective to prevent the flange 15L from releasing from the developing sleeve 5. To the groove 21*a* of the flange 15L, a bias electrode 22 is inserted and fixed. With a projection 21*c* of the shaft portion 15*b*, a hole 22*e* of the bias electrode 22 is engaged, and a cut and bent portion 22*c* of the hole 22*e* is engaged to prevent the bias electrode 22 from releasing from the flange 15L. The other end of the bias electrode 22 is formed into a bent portion 22*d* bent toward the center of the flange 15L. It is contacted to an end surface of the flange so that the bias electrode 22 is mounted without play relative to the flange 15L.

The flange 15L is provided with a groove (not shown) similar to the groove 21*a* at a position facing the bias electrode 22 (bottom portion in the Figure). By mounting a bias electrode 22' having the same configuration as the bias electrode 22 in the groove, the contact area with the electrode plate 17 is increased, thus enhancing the reliability.

The bias electrodes 22 and 22' may be of a single part connected with each other at a rear side of the sleeve flange 21.

Figure 5A:
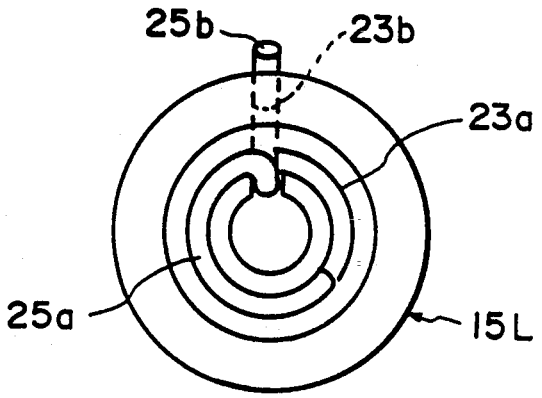
FIG. 5A is a front view of a flange and a bias electrode according to a further embodiment of the present invention.
Figure 5B:
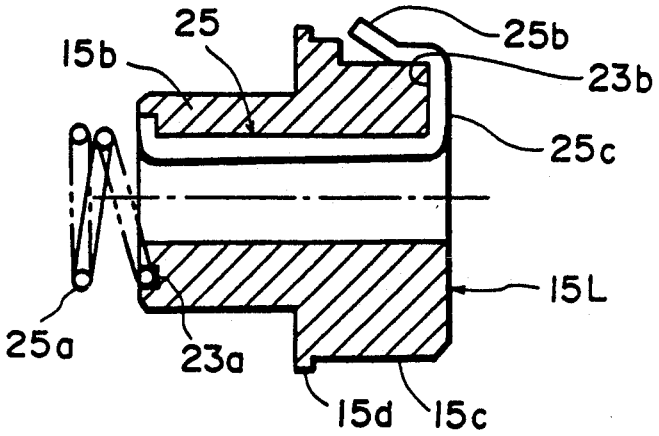
FIG. 5B is a longitudinal sectional view of the FIG. 5A embodiments.
Figure 6:
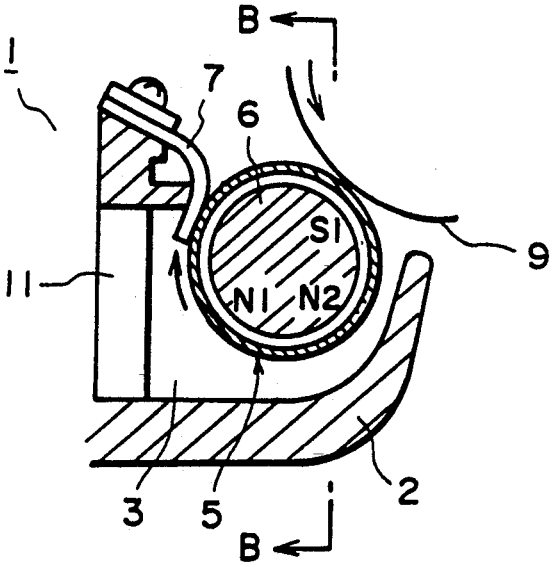
FIG. 6 (PRIOR ART)
FIG. 6 is a sectional view of a conventional developing apparatus.
Figure 7:
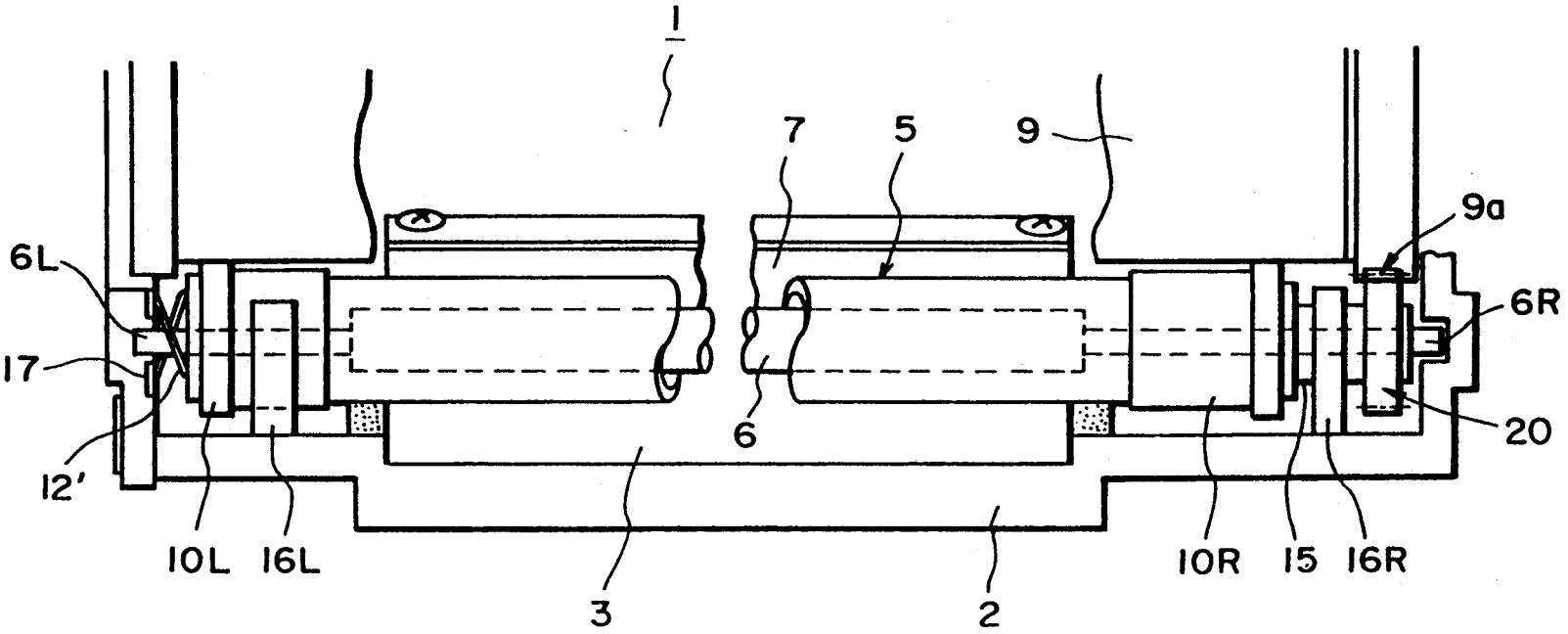
FIG. 7 (PRIOR ART)
FIG. 7 is a sectional view taken along a line B—B of FIG. 6.
Figure 8:
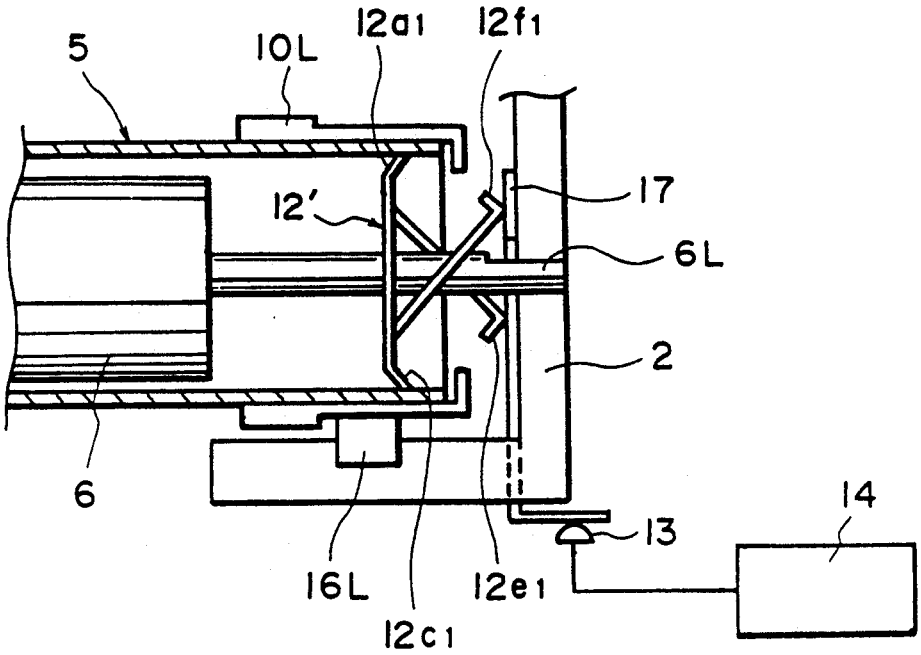
FIG. 8 (PRIOR ART)
FIG. 8 is an enlarged longitudinal sectional view of an area around a conventional bias electrode.
Figure 9:
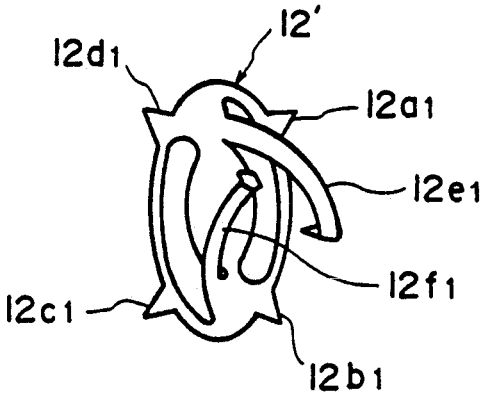
FIG. 9 (PRIOR ART)
FIG. 9 is an enlarged perspective view of the bias electrode of FIG. 8.

Referring to FIGS. 5A and 5B, a further embodiment of the flange will be described. In these Figures, the bias electrode 25 is extended through an inside of the flange 15L. The bias electrode 25 is made of piano wire, stainless wire used for springs or phosphor bronze wire or the like. A spring portion 25*a* in the form of a coil spring has a spring property and is slidably contacted to the fixed electrode plate 17 with a predetermined contact pressure. The other end of the spring 25*a* is engaged with a groove 23*a* of the flange 15L. The groove 23*a* is connected with a groove 23*b* in which the bias electrode 25 is engaged and fixed. In this embodiment, the bias electrode 25 is fixed at the radially inside position of the flange 15L. In this case, in order to avoid interference with the shaft portion 6L of the magnet roller 6, releasing is prevented by engagement between one end of the groove 23*a* and the spring portion 25*a*. The other end of the bias electrode 25 is formed into a bent portion 25*c* extending toward the outside of the flange 15L and further formed into a resilient portion 25*b* which is bent along the flange 15L and which projects from the outer periphery of the flange 15L. The resilient portion 25*b*, when the flange 15L is press fitted into the sleeve 5, is electrically connected with the developing sleeve 5. The resilient portion 25*b* of the bias electrode 25, when it is inserted into and fixed to the developing sleeve 5, is in the form of a wedge to prevent release of the flange 15L from the sleeve 5. In any of the foregoing embodiments, the bias electrode is supported by the flange 15L fixed on the sleeve 5, and therefore, displacement toward the longitudinal sleeve center is prevented despite the fact that it receives a reaction force by the elastic contact to the electrode plate 17 in a direction toward the center of the sleeve. Therefore, the stabilized contact with the electrode plate 17 is maintained at all times. This permits high quality image development.

If the large diameter portion 15*d* is provided as shown in the Figure at the left end of the engaging portion 15*c* for the sleeve 5 of the flange 15L, and if the right side end surface of the large diameter portion 15*d* is contacted to the left end surface of the sleeve 5, the displacement of the flange 15L toward the sleeve center is assuredly prevented, by which the displacement of the bias electrode toward the sleeve center is further assuredly prevented.

Since the shaft portion 15*b* of the flange 15L fixed to the sleeve 5 is supported by the bearing 16L without being obstructed by the bias electrode, the sleeve 5 can be positioned with high positional accuracy , the positional accuracy of the magnet roller 6 in the radial direction can be maintained high, and therefore, a good developed image can be formed.

Figure 11:
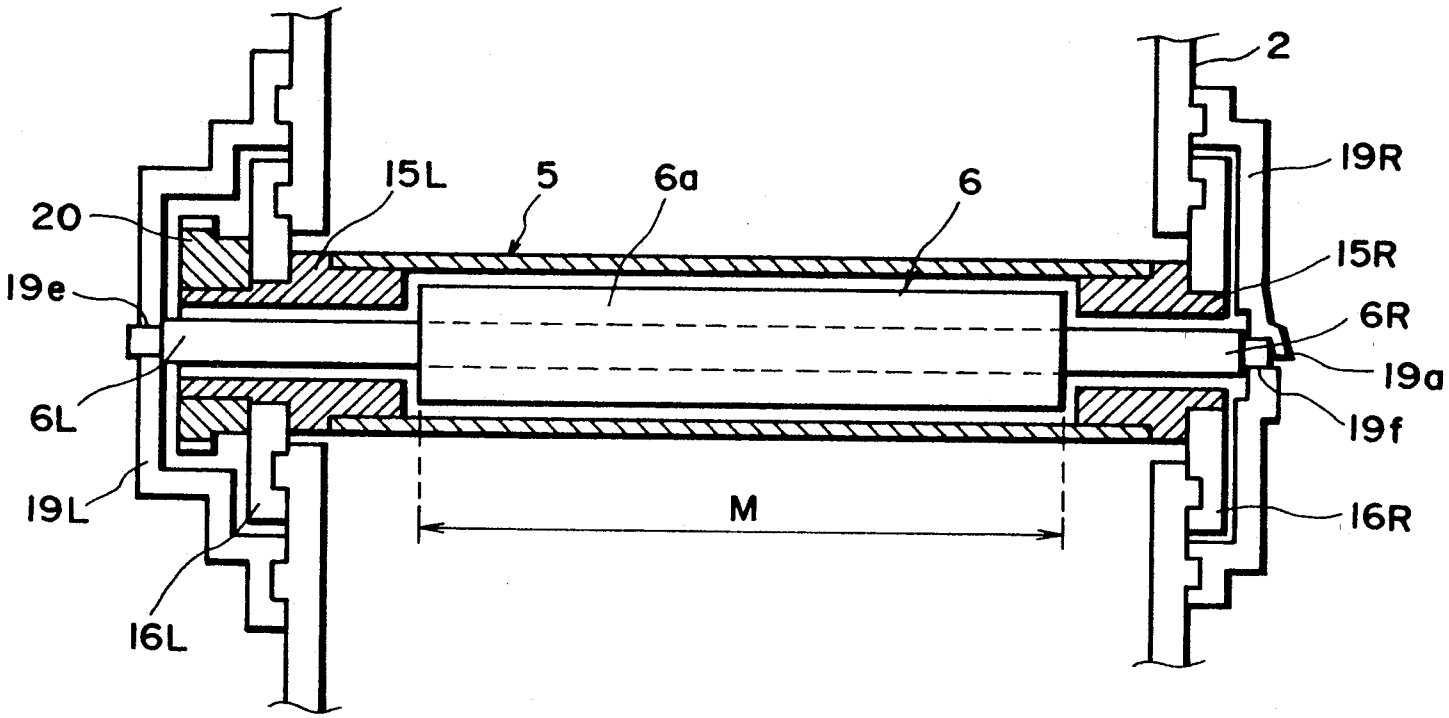
FIG. 11 is a sectional view of a developing apparatus according to a further embodiment of the present invention.
Figure 12:
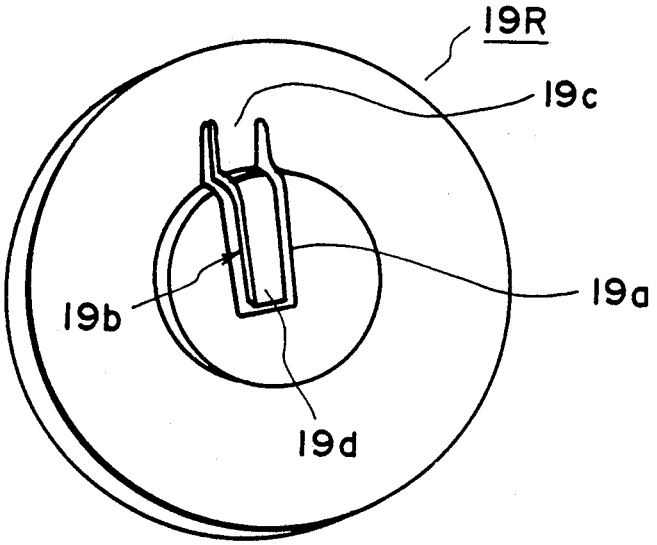
FIG. 12 is a perspective view of a holder used in the apparatus of the FIG. 11 embodiment.
Figure 13:
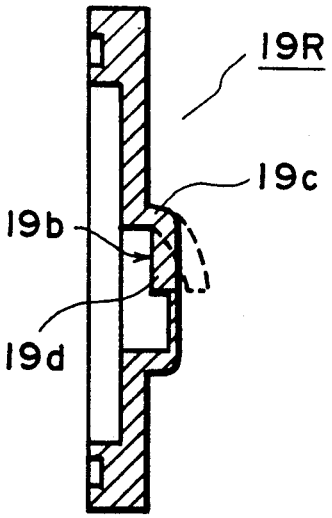
FIG. 13 is a sectional view of the holder of FIG. 11.

Referring to FIG. 11, a further embodiment will be described, in which longitudinal end portions of the shaft portions 6L and 6R of the magnet roller 6 are inserted into and fixed to holes 19*e* and 19*f* of the holder 19L and 19R fixed to the developer container. The developing sleeve 5 is disposed to enclose the magnet roller 6 with a small clearance from a magnetized portion 6*a* of the magnet roller 6. To the left and right ends of the sleeve, the flanges 15L and 15R are respectively fixed by bonding or press-fitting. The sleeve flanges 15L and 15R are supported by bearings 16L and 16R fixed on the container 2. To the left sleeve flange 15L, a sleeve gear 20 is fixed, which is driven by way of a driving gear fixed on the photosensitive member, so that the developing sleeve 5 rotates in the predetermined direction. The holder 19R supporting the right portion of the magnet roller 6, as shown in FIGS. 12 and 13, is provided with a tongue 19*b* enclosed in three directions by slits 19*a*. The tongue 19*b* is resiliently deformable about a base portion 19*c*, as shown by broken lines in FIG. 13. The end portion 19*d* urges in a thrust direction the right end of the shaft portion 6R of the magnet roller 6. In other words, the entirety of the magnet roller 6 is maintained urgedly to the holder 19L by being resiliently urged to the left as viewed in FIG. 11. Thus, the holder 19L is correctly positioned in the thrust direction of the magnet roller 6.

In this manner, the magnet roller 6 may be maintained at the predetermined position in the thrust direction, and therefore, the magnetic force acts stably in the region M of the developing sleeve 5 that is facing the image. By doing so, it is avoided that the toner T is supplied to the outside of the image region M, and therefore, the toner T is not consumed wastefully.

It is preferable that the tongue 19*b* of the holder 19R is made of high strength and elastic synthetic resin material such as synthetic resin material, for example, polyphenylene ether resin, polyacetal resin or the like, to permit elastic deformation.

Figure 15:
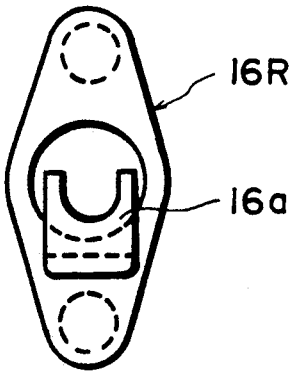
FIG. 15 is a front view of a bearing used in the FIG. 14 embodiment apparatus.
Figure 14:
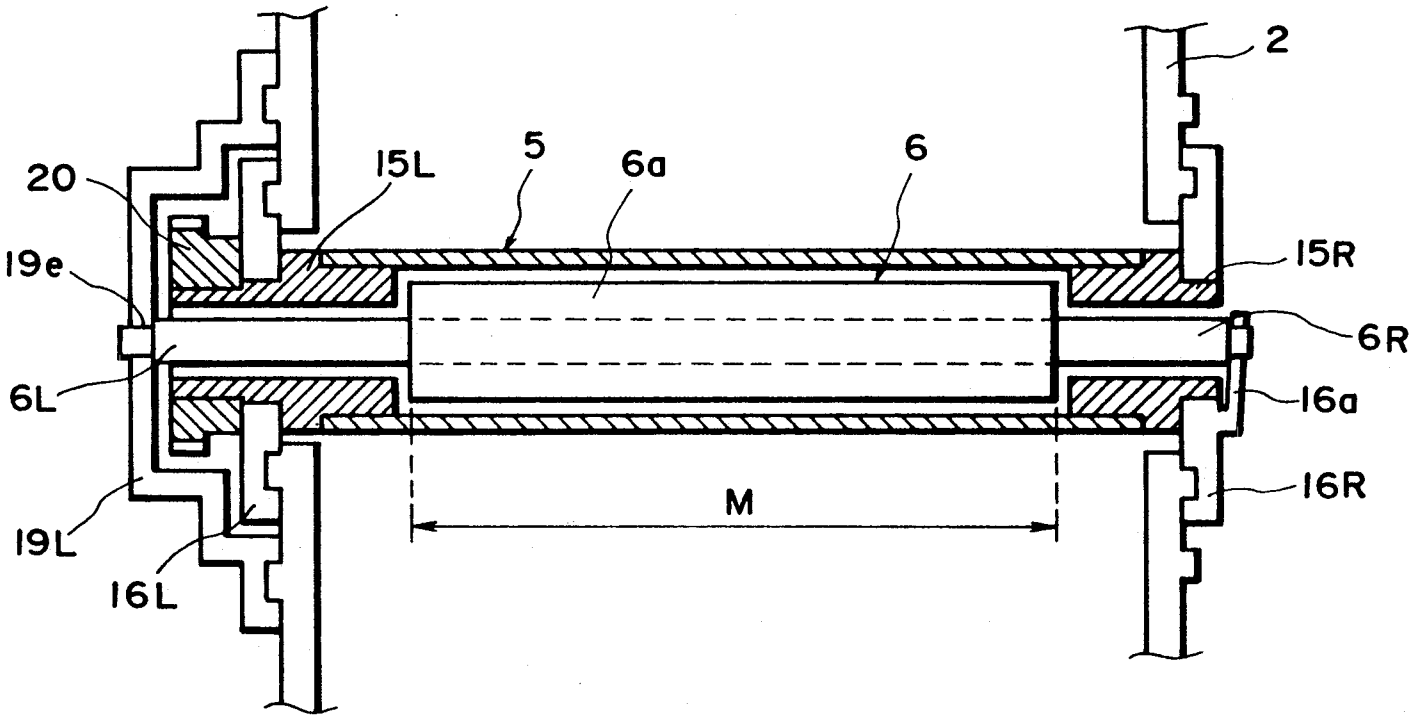
FIG. 14 is a sectional view of a developing apparatus according to a further embodiment of the present invention.

Referring to FIGS. 14 and 15, there is shown another embodiment in which a part of the bearing 16R is elastically deformable. The bearing 16R for supporting the flange 15R is integrally provided with a receiving portion 16*a* for receiving and supporting the shaft portion 6R of the magnet roller 6. The receiving portion 16*a* is so formed as to be elastically deformable upon thrust force applied thereto. Therefore, the magnet roller 6 is always urged in a constant direction with the elastic force of the receiving portion 16*a*. Thus, the magnet roller can be positioned at a predetermined position in the thrust direction. By the formation of the receiving portion 16*a* capable of elastic deformation in the bearing 16R, the number of parts can be reduced, and the space in the thrust direction can be reduced.

Figure 16:
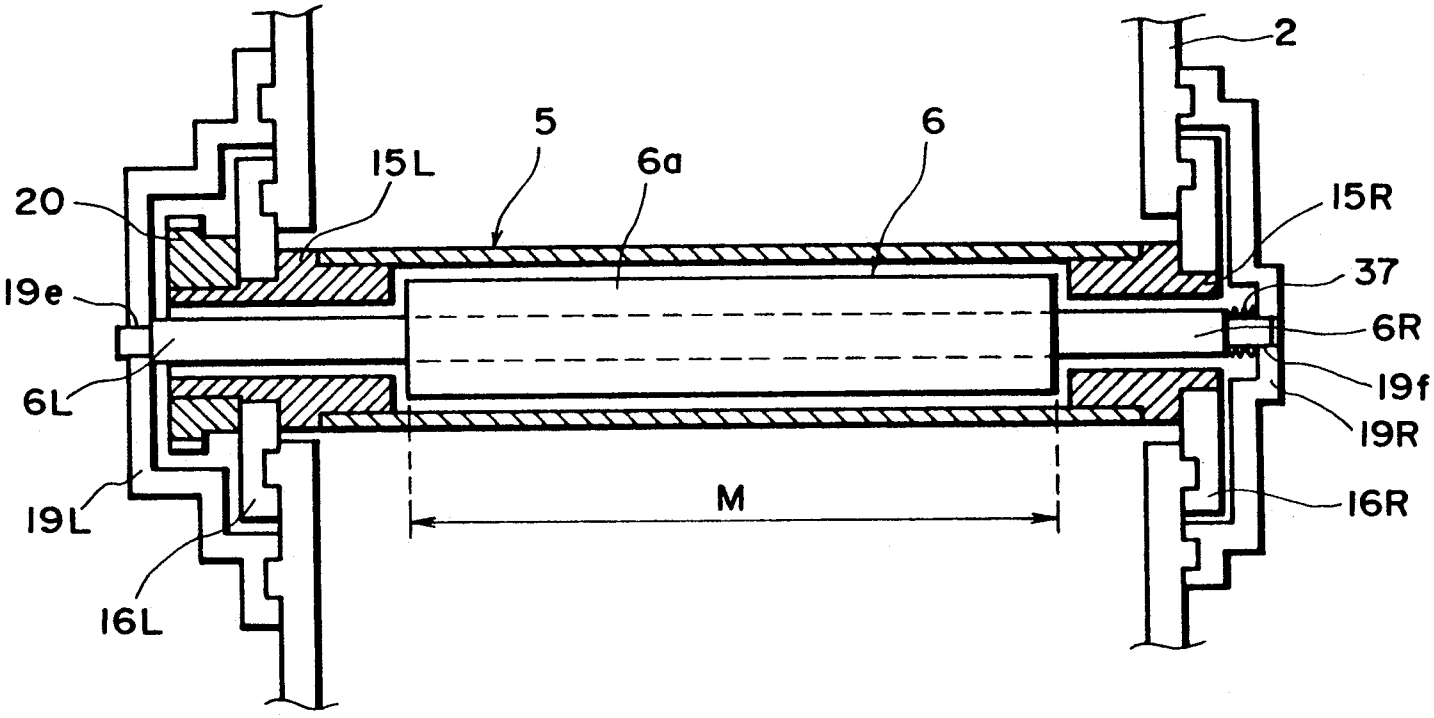
FIG. 16 is a sectional view of a developing apparatus according to a yet further embodiment of the present invention.
Figure 17:
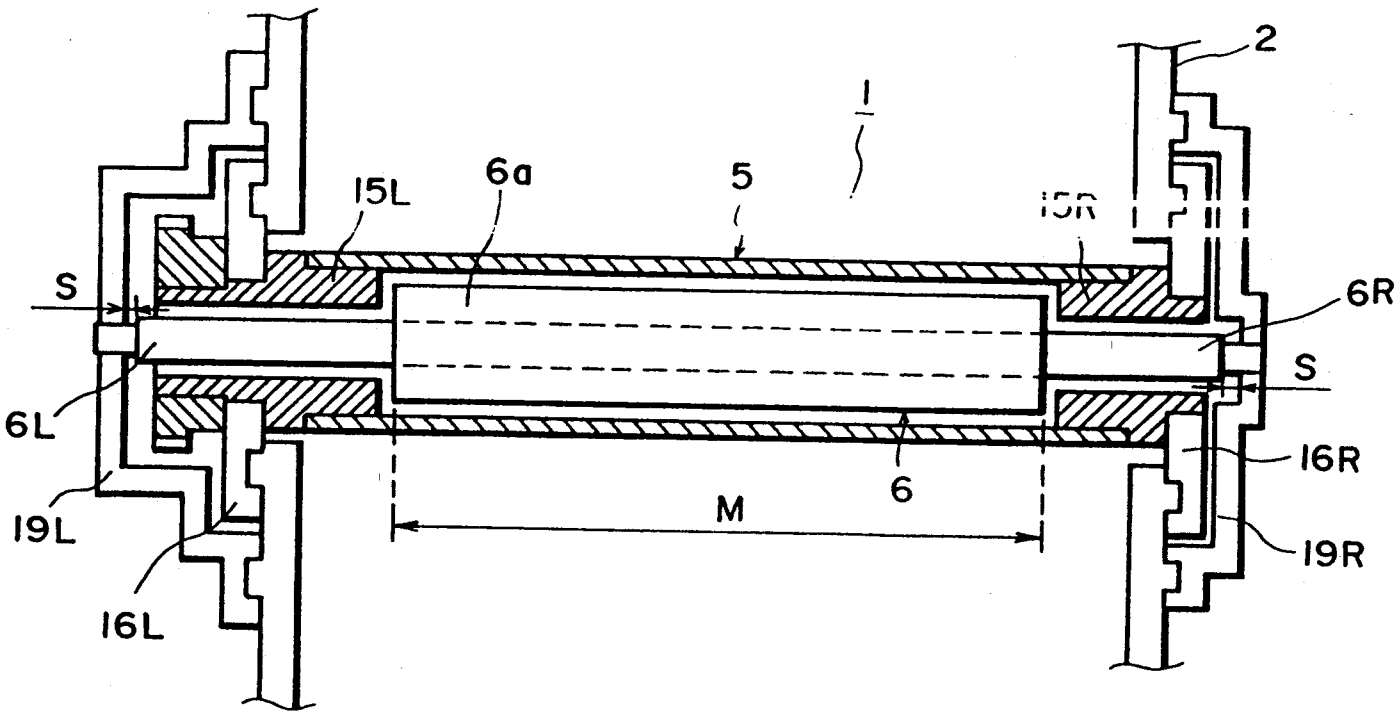
FIG. 17 (PRIOR ART)
FIG. 17 is a sectional view of a conventional developing apparatus.

It is preferable that the bearing 16R is also molded of synthetic resin material such as polyphenylene ether resin or polyacetal resin or the like. Referring to FIG. 16, a further embodiment will be descried, in which a coil spring member 37 engaged with the shaft portion 6R of the magnet roller 6 is added to the holder 19R for fixing the magnet roller 6, by which the magnet roller is urged in the leftward direction as viewed in FIG. 16.

In the embodiments of FIGS. 11–16, the magnet roller 6 can be assuredly maintained at the predetermined position in the thrust direction, and the thrust displacement can be prevented. Therefore, wasteful consumption of the developer and image degradation can be prevented, and in addition, the assembling tolerances can be reduced with the advantage of reducing the size of the apparatus.

The above-described bias electrode may be mounted to the flange of FIG. 11, 14 or 16.

Each of the above-described developing apparatuses is usable with a process cartridge, as will be described hereinafter.

Figure 10:
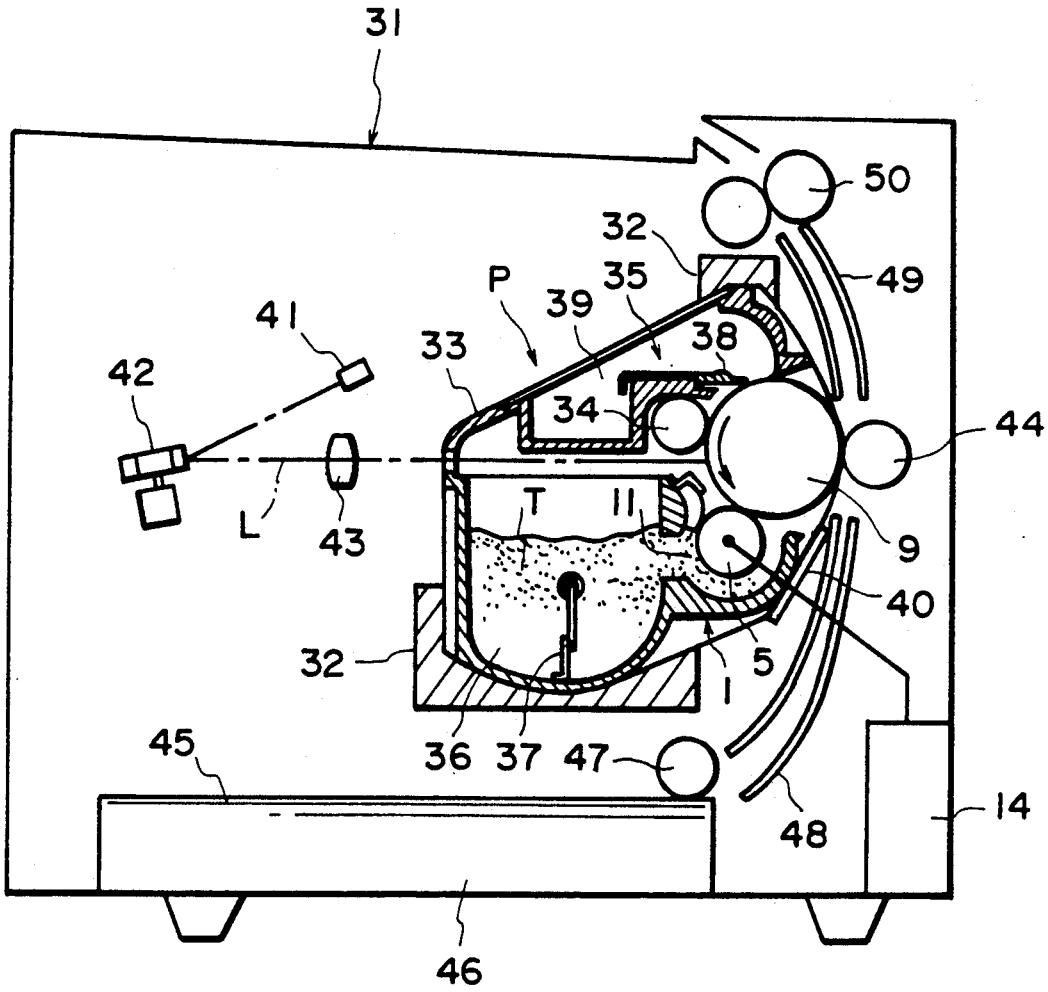
FIG. 10 is a sectional view of a printer having a process cartridge.

In FIG. 10, the process cartridge P is detachably mountable relative to the main assembly of the printer by manipulation of an operator along guide rails 32 in the main assembly of the laser beam printer 31. When the toner is used up or when the service life of the photosensitive member 9 is reached, the operator takes the used-up cartridge P out of the main assembly of the printer, and a fresh cartridge P is loaded into the main assembly. The process cartridge P is provided with an electrophotographic photosensitive member 9 in the form of a drum, a charger 34, the above-described developing device 1 and a cleaning device 35. Those means 9, 34, 1 and 35 are integrally supported on a supporting frame 33. The developing device 1 comprises, in addition to the various parts described hereinbefore, a toner container 36 for containing fresh toner T. The toner in the container 36 is supplied to the sleeve through an opening 11 by a feeding member 37, as described hereinbefore. The opening 11 is provided with a sealing member (not shown) so as to prevent the toner T in the developer container 36 from moving to the developing sleeve, thus leaking the toner T out of the process cartridge P, before the process cartridge P is used. When the process cartridge P is mounted in the main assembly of the image forming apparatus, the unshown sealing member is manipulated to open the opening 11 to permit the toner T in the developer container 36 to be supplied to the developing sleeve.

The cleaning means 35 comprises a cleaning blade 38 for removing residual toner from the photosensitive member by scraping the photosensitive member 9, residual toner container 39 for containing the residual toner removed by the cleaning blade 38. It is effective to remove the residual toner from the photosensitive member 9 to prepare it for the next image forming operation.

The process cartridge P is provided with a protection shutter 40 for the photosensitive member 9. When the process cartridge P is mounted in the main assembly of the image forming apparatus, the shutter 40 is retracted to one side of the photosensitive member 9.

Upon the image forming operation, the photosensitive member is first charged uniformly by the charger 34 and is exposed to a scanning laser beam L, so that an electrostatic latent image is formed on the photosensitive member 9. A semiconductor laser 41 emits a laser beam L which is modulated in accordance with an image supplied from an original reader, computer or the like. The laser beam L is deflected by scanning means 42 including a rotatable polygonal mirror or the like to project the laser beam L onto the photosensitive member 9 through a lens 43. The electrostatic latent image formed on the photosensitive member 9 is developed by the developing device which has been described hereinbefore. The visualized image provided by the developing operation is transferred onto a transfer material 45 from the photosensitive member 9 by a transfer roller 44.

The transfer material 45 is fed from a cassette 46 to the transfer roller 44 by a feeding roller 47 along a guide 48. After the image transfer operation, the transfer material 45 is conveyed on a guide 49 to a fixing device 50 which fixes the image on the transfer material. Then, the transfer material is discharged to outside the main assembly.

A voltage source 14 is electrically connected with the developing sleeve 5 of the developing device when the cartridge P is loaded into the main assembly of the printer 31 at the image forming operation position, so that the developing bias can be applied to the developing sleeve during the developing operation.

While the invention has been described with reference to the structures disclosed herein, it is not confined to the details set forth and this application is intended to cover such modifications or changes as may come within the purposes of the improvements or the scope of the following claims.

What is claimed is:

1. A developing apparatus for developing an electrostatic latent image, comprising:
- a fixed electrode for receiving a developing bias voltage;
- a rotatable and electrically conductive sleeve for carrying a developer to a developing zone, to supply the developer to the electrostatic latent image;
- a flange fixed to an end of said sleeve, said flange including an electrode supporting portion; and
- an elastic electrode fixedly supported on said flange, said elastic electrode including a first portion engaged with the electrode supporting portion, a second portion press-contacted to said sleeve, and a third portion elastically and slidably press-contacted to said fixed electrode.

2. An apparatus according to claim 1, further comprising a shaft member for supporting a shaft portion of said flange at an areas outside of said sleeve.

3. An apparatus according to claim 2, wherein the electrode supporting portion comprises a groove formed in said flange, and the first portion of said elastic electrode is disposed in the groove.

4. An apparatus according to claim 3, wherein the groove is formed in an outer surface of the shaft portion supported by said bearing member.

5. An apparatus according to any one of claims 1–4, wherein the first portion of said elastic electrode comprises a bent portion that contacts outer and inner surfaces of said flange member, and wherein said bent portion sandwiches said flange member.

6. An apparatus according to any one of claims 1–4, wherein the electrode supporting portion comprises a projection from said flange, and said elastic electrode is provided with a hole engageable with the projection.

7. An apparatus according to any one of claims 1–4, wherein the second portion of said elastic electrode is press-contacted between an outer surface of said flange and an inner surface of said sleeve.

8. An apparatus according to any one of claims 1–4, wherein the second portion of said elastic electrode is elastically press-contacted to an inner surface of said sleeve in a position such that a resistance against movement of said flange away from said sleeve is larger than a resistance against insertion of said flange into said sleeve.

9. An apparatus according to any one of claims 1–4, wherein said flange is composed of synthetic resin material.

10. An apparatus according to any one of claims 1–4, further comprising a magnet disposed in said sleeve.

11. A process cartridge detachably mountable to a main assembly of an image forming apparatus, comprising:
- a supporting member;
- an image bearing member supported on said supporting member;
- a developing device for developing an electrostatic latent image formed on said image bearing member;
- said developing device including;
- a fixed electrode for receiving a developing bias voltage;
- a rotatable and electrically conductive sleeve for carrying a developer to a developing zone, to supply the developer to the electrostatic latent image;
- a flange fixed to an end of said sleeve, said flange including an electrode supporting portion; and
- an elastic electrode fixedly supported on said flange, said elastic electrode including a first portion engaged with the electrode supporting portion, a second portion press-contacted to said sleeve, and a third portion elastically and slidably press-contacted to said fixed electrode.

12. A process cartridge according to claim 11, further comprising a bearing member for supporting a shaft portion of said flange at an outside area of said sleeve.

13. A process cartridge according to claim 12, wherein the electrode supporting portion comprises a groove formed in said flange, and the first portion of said elastic electrode is disposed in the groove.

14. A process cartridge according to claim 13, wherein the grove is formed in an outer surface of the shaft portion supported by said bearing member.

15. A process cartridge according to any one of claims 11–14, wherein the first portion of said elastic electrode comprises a bent portion for sandwiching outer and inner surfaces of said flange member.

16. A process cartridge according to any one of claims 11–14, wherein the electrode supporting portion comprises a projection from said flange, and said elastic electrode is provided with a hole engageable with the projection.

17. A process cartridge according to any one of claims 11–14, wherein the second portion of said elastic electrode is press-contacted between an outer surface of said flange and an inner surface of said sleeve.

18. A process cartridge according to any one of claims 11 ∝ 14, wherein the second portion of said elastic electrode is elastically press-contacted to an inner surface of said sleeve in a position such that a resistance against movement of said flange away from said sleeve is larger than a resistance against insertion of said flange into said sleeve.

19. A process cartridge according to any one of claims 11–14, wherein said flange is composed of synthetic resin material.

20. A process cartridge according to any one of claims 11–14, further comprising a magnetic disposed in said sleeve.

21. A developing device for developing an electrostatic latent image, comprising:

a sleeve for carrying a developer to a developing zone to supply the developer to the electrostatic latent image;

a bearing for rotatably supporting said sleeve;

a magnet disposed in said sleeve and comprising a shaft;

a positioning member for supporting an end of the shaft of said magnet and for positioning said magnet in a thrust direction; and an urging member for elastically urging said magnet in the thrust direction toward said positioning member, wherein said urging member is integral with said bearing and said urging member is elastically press-contacted to the other end of the shaft of said magnet.

22. A process cartridge detachably mountable to a main assembly of an image forming apparatus, comprising:

a supporting member;

an image bearing member supported on said supporting member;

a developing device for developing an electrostatic latent image formed on said image bearing member, said developing device being supported on said supporting member and including:

a sleeve for carrying a developer to a developing zone, to supply the developer to the electrostatic latent image;

a bearing for rotatably supporting said sleeve;

a magnet disposed in said sleeve and having a shaft;

a positioning member for supporting an end of the shaft of said magnet and for positioning said magnet in a thrust direction; and an urging member for elastically urging said magnet in the thrust direction toward said positioning member, wherein said urging member is integral with said bearing and said urging member is elastically press-contacted to the other end of the shaft of said magnet.

23. A developing device for developing an electrostatic latent image, comprising:

a sleeve for carrying a developer to a developing zone to supply the developer to the electrostatic latent image;

a magnet disposed in said sleeve;

a positioning member for supporting an end of a shaft portion of said magnet and for positioning said magnet in a thrust direction; and a holder for supporting the other end of the shaft portion of said magnet, said holder having a tongue which is circumscribed by a slit except for a base portion thereof, wherein said tongue is resiliently press-contacted to the other end of the shaft portion of said magnet to urge said magnet toward said positioning member in a thrust direction.

24. A process cartridge detachably mountable to a main assembly of an image forming apparatus, comprising:

a supporting member;

an image bearing member supported on said supporting member;

a developing device for developing an electrostatic latent image formed on said image bearing member, said developing device being supported on said supporting member and including:

a sleeve for carrying a developer to a developing zone, to supply the developer to the electrostatic latent image;

a magnet disposed in said sleeve;

a positioning member for supporting an end of a shaft portion of said magnet and for positioning said magnet in a thrust direction; and a holder for supporting the other end of the shaft portion of said magnet, said holder having a tongue which is circumscribed by a slit except for a base portion thereof, wherein said tongue is resiliently press-contacted to the other end of the shaft portion of said magnet to urge said magnet toward said positioning member in a thrust direction.

* * * * *

UNITED STATES PATENT AND TRADEMARK OFFICE

CERTIFICATE OF CORRECTION

PATENT NO. : 5,283,619

DATED : February 1, 1994

INVENTOR(S) : YOSHIYA NOMURA, ET AL.

It is certified that error appears in the above-indentified patent and that said Letters Patent is hereby corrected as shown below:

COLUMN 2

Line 10, "electrode 12' " should read --electrode 12' is--.

Line 63, "respectively" should read --respectively,--.

Line 65, "respectively" should read --respectively,--.

Line 68, "portion 63" should read --portion 6a--.

COLUMN 4

Line 40, "gear 92" should read --gear 9a--.

COLUMN 5

Line 41, "groove 5a" should read --groove 15a--.

Line 47, "bearing 16L," should read --bearing 16L.--.

COLUMN 7

Line 16, "accuracy ," should read --accuracy,--.

COLUMN 9

Line 53, "areas" should read --area--.

UNITED STATES PATENT AND TRADEMARK OFFICE

CERTIFICATE OF CORRECTION

PATENT NO. : 5,283,619

DATED : February 1, 1994

INVENTOR(S) : YOSHIYA NOMURA, ET AL.

It is certified that error appears in the above-indentified patent and that said Letters Patent is hereby corrected as shown below:

COLUMN 10

Line 66, "claims 11 ∝ 14," should read --claims 11-14,--.

COLUMN 11

Line 8, "magnetic" should read --magnet--.

Signed and Sealed this

Twenty-sixth Day of July, 1994

Bruce Lehman

*Attest:*

BRUCE LEHMAN

*Attesting Officer*

*Commissioner of Patents and Trademarks*